United States Patent [19]

Willett

[11] 4,192,555

[45] Mar. 11, 1980

[54] METHOD OF DISPOSING SOLID SODIUM CHLORIDE WHILE SELECTIVELY SOLUTION MINING POTASSIUM CHLORIDE

[75] Inventor: Boyd R. Willett, Denver, Colo.

[73] Assignee: PPG Industries Canada Ltd., Regina, Canada

[21] Appl. No.: 935,821

[22] Filed: Aug. 22, 1978

[51] Int. Cl.[2] ..... E21B 43/28

[52] U.S. Cl. ..... 299/4; 405/58

[58] Field of Search ..... 299/4, 5; 405/58, 59

[56] References Cited

U.S. PATENT DOCUMENTS

| | | | |
|---|---|---|---|
| 3,058,729 | 10/1962 | Dahms et al. | 299/4 |
| 3,148,000 | 9/1964 | Dahms et al. | 299/5 |
| 3,366,419 | 1/1968 | Pasternak et al. | 299/5 |
| 3,586,378 | 6/1971 | Dietz | 299/5 |
| 3,600,039 | 8/1971 | Porter | 299/5 |
| 3,606,466 | 9/1971 | Fernandes | 299/5 |
| 4,007,964 | 2/1977 | Goldsmith | 299/4 |

FOREIGN PATENT DOCUMENTS

| | | | |
|---|---|---|---|
| 951336 | 7/1974 | Canada | 299/5 |

*Primary Examiner*—Ernest R. Purser

*Attorney, Agent, or Firm*—Walter M. Benjamin

[57] ABSTRACT

Disclosed is a method of disposing solid sodium chloride while selectively solution mining potassium chloride from a subterranean deposit containing potassium chloride and sodium chloride. In this novel method an aqueous solvent saturated with respect to sodium chloride, unsaturated with respect to potassium chloride and slurried with solid sodium chloride, is fed into the deposit having a cavity wherein there is face on which rich and lean potassium chloride ore is exposed. Potassium chloride is thereby dissolved while sodium chloride is deposited from the solvent slurry and the resultant solution withdrawn from the cavity enriched in potassium chloride.

13 Claims, 3 Drawing Figures

METHOD OF DISPOSING SOLID SODIUM CHLORIDE WHILE SELECTIVELY SOLUTION MINING POTASSIUM CHLORIDE

BACKGROUND OF THE INVENTION

This invention relates to a method of disposing solid sodium chloride, more particularly it relates to a method of disposing solid sodium chloride while selectively solution mining potassium chloride from a subterranean ore deposit.

Potassium chloride is solution mined from subterranean deposits containing potassium chloride and sodium chloride by circulating through the deposit water or an aqueous solvent unsaturated with respect to potassium chloride. A solution richer in potassium chloride than the solvent is withdrawn from the deposit as a cavity is developed therein. Potassium chloride values are extracted from the enriched solution in an above ground process.

By solution mining in this manner with water as a solvent both potassium chloride and sodium chloride are extracted from the deposit non-selectively. However, as the temperature is increased and as the sodium chloride content of the solvent is increased, the more selectively the potassium chloride is mined from the deposit (i.e., the greater the ratio of KCl/NaCl mined). Hence, the composition and temperature of the solvent can be adjusted to efficaciously mine a deposit according to its ratio of potassium chloride to sodium chloride, see for example U.S. Pat. No. 3,058,729 to Dahms, et al.

These deposits typically contain high sodium chloride content i.e., sodium chloride content so high that for each kilogram of potassium chloride values produced by a refinery process such as where a solution of potassium chloride containing ore is concentrated by evaporation and subsequently cooled or where ore is treated by froth flotation, approximately two kilograms of sodium chloride are produced. Hence, on an average the ore contains about twice as much sodium chloride as potassium chloride. Unfortunately, the subterranean ore deposits are not uniform but comprise potassium chloride-rich and potassium chloride-lean strata. Therefore, where attempts are made to selectively mine upwardly through each stratum, difficulties are encountered because extraction of potassium chloride from a potassium chloride-lean stratum will not cause sodium chloride crystals to loosen; consequently, a sodium chloride barrier for further extraction is incumbent. On the other hand, where all strata are non-selectively mined, enormous quantities of sodium chloride must be discarded, either as a solid or in solution.

U.S. Pat. No. 3,366,419 to Pasternak, et al. discloses a method of non-selectively and selectively mining strata alternately lean and rich in potassium chloride by using solvents unsaturated and saturated with respect to sodium chloride, respectively. Also solid sodium chloride is slurried with solvents saturated with respect to sodium chloride during selective mining, thereby avoiding accumulation of produced sodium chloride. This method is undesirable since strata are mined upwardly therethrough whereby it is difficult to ascertain exactly when transitions between a rich and lean strata are encountered. Moreover, many rich strata are so thin that they are not detected or is not worth the encumbrance of switching to selective mining. Further, by the time produced solution is analyzed for ore composition ratio, difficulties which are to be avoided, e.g., plugging of conduits, can arise before adjustments are made. Hence, shutdowns during the process can be experienced. Additionally, selective mining in this manner is a relatively slow process, even at relatively high temperatures. Hence, this method produces potassium chloride at an undesirably slow continuous rate.

It is therefore a desideratum that sodium chloride be disposed into a cavity in a manner that is less burdensome and conducive to fast production rates.

SUMMARY OF THE INVENTION

It has been found that potassium chloride can be extracted at relatively fast continuous rates from subterranean ore deposits comprising alternating rich and lean potassium chloride strata while solid sodium chloride is disposed in a cavity developed thereby or a cavity already developed. Accordingly, ore having a large face (area traversing the strata) is mined with a solvent in which solid sodium chloride is slurried.

In one embodiment, after a large cavity has been developed to a point where it would ordinarily be abandoned, walls are exposed whereon there are large surface areas traversing the strata which are rich and lean in potassium chloride. Both, the rich and lean strata are selectively mined simultaneously with a solvent slurried with solid sodium chloride. As strata which are rich in potassium chloride are mined, some lean strata falls to the floor of the cavity thereby exposing further rich strata to be mined. Also, large surface areas of lean strata are mined until layers of sodium chloride become encumbent but also fall to the floor of the cavity. In addition, for about every 7 parts potassium chloride extracted from the ore by the solvent which is saturated with respect to sodium chloride, 1 part sodium chloride which is in solution is precipitated and deposited from the solvent. Hence, with enough solid sodium chloride delivered to the cavity by both, precipitation from the solvent liquor and convection by the slurry, sodium chloride is disposed of and the possibility or extent of surface subsidence is decreased. It is only preferred that solid sodium chloride be delivered to the cavity in such a manner that the large face surface area is not buried.

In another embodiment of the present invention, a cavity is developed in strata relatively lean in potassium chloride content and which are underburden to strata relatively rich in potassium chloride content. A rubble bed of the rich strata is caused to be collapsed into the cavity as taught by U.S. Pat. No. 3,148,000. Except, a solvent slurried with solid sodium chloride is then percolated down through the rubble pile thereby selectively extracting potassium chloride therefrom. As the rubble pile is mined, voids are filled in by the solid sodium chloride which is slurried with the solvent. Hence, smaller cavities are created wherein subsidence is less likely to occur.

In a further embodiment of the present invention, a vertical elongated cavity is developed through layers of rich and lean strata which form a relatively rich strata which extends downwardly into relatively lean strata and upward to the uppermost part of the rich strata. The face (cavity walls) is selectively mined with solvent slurried with solid sodium chloride thereby developing the cavity laterally utilizing an insulating blanket to protect the roof thereof. A wider and shallow cavity may be developed at the bottom and in communication with the vertically elongated cavity to allow room for solid sodium chloride and insolubles to fall without burying the face of the rich strata.

In even a further embodiment of the present invention, the face of rooms which have been mined by conventional room and pillar type mining is selectively mined by using a solvent in which solid sodium chloride is slurried. Bore holes are drilled from the surface into the lowest points in the mine workings and cased to allow withdrawal of fluids from these points. Other bore holes are drilled into the ore body to higher points which are in communication with the lowest points. The solvent is then caused to flow into the highest point and withdrawn from the lowest point. By this method essentially all of remaining potassium chloride can be extracted from a mine which is abandoned as far as conventional underground room and pillar mining is concerned. Moreover, excess sodium chloride produced by conventional flotation methods can be disposed of. Additionally, maps showing the grade of ore deposits, topography of the beds and mine workings are usually made in detail during room and pillar mining; consequently, this situation is ideally suitable for the present invention with respect to strategy utilized for further cavity development.

This invention has the advantage of selectively mining at relatively fast continuous rates with relatively less difficulty while disposing large quantities of solid sodium chloride that may be produced during above surface refining. It also has the advantage of mining using a saturated sodium chloride solution so that there is no net solid sodium chloride produced during surface refining. Less fresh water need be added to a system as well, owing to a cavity which is essentially not enlarged during selective mining. Surface subsidence is also minimized because of smaller cavities developed and because of deposited solid sodium chloride which supports developed cavities. During selective mining of inactivated or abandoned solution mined cavities, large volumes of brine rich in potassium chloride are displaced by the solid sodium chloride.

This invention is particularly useful for an operation which has operated for a number of years and has accumulated a large quantity of solid sodium chloride salt. The environmental impact of this salt stored above ground can be relieved by forwarding to an inactivated or abandoned cavity or room the slurry of the solid sodium chloride with above ground process effluent solution saturated with respect to sodium chloride. Also, the solid sodium chloride can be slurried with saturated sodium chloride solutions from newly developed solution mined cavities before being forwarded to an inactivated or abandoned cavity or room.

This invention is particularly effective where potassium chloride rich strata have an average of above about 15 percent $K_2O$ content or above about 23 percent potassium chloride by weight.

BRIEF DESCRIPTION OF THE DRAWINGS

Other advantages and benefits of the present invention will become apparent from the detailed description below made with reference to the drawings in which.

DETAILED DESCRIPTION OF THE INVENTION

Figure 1:
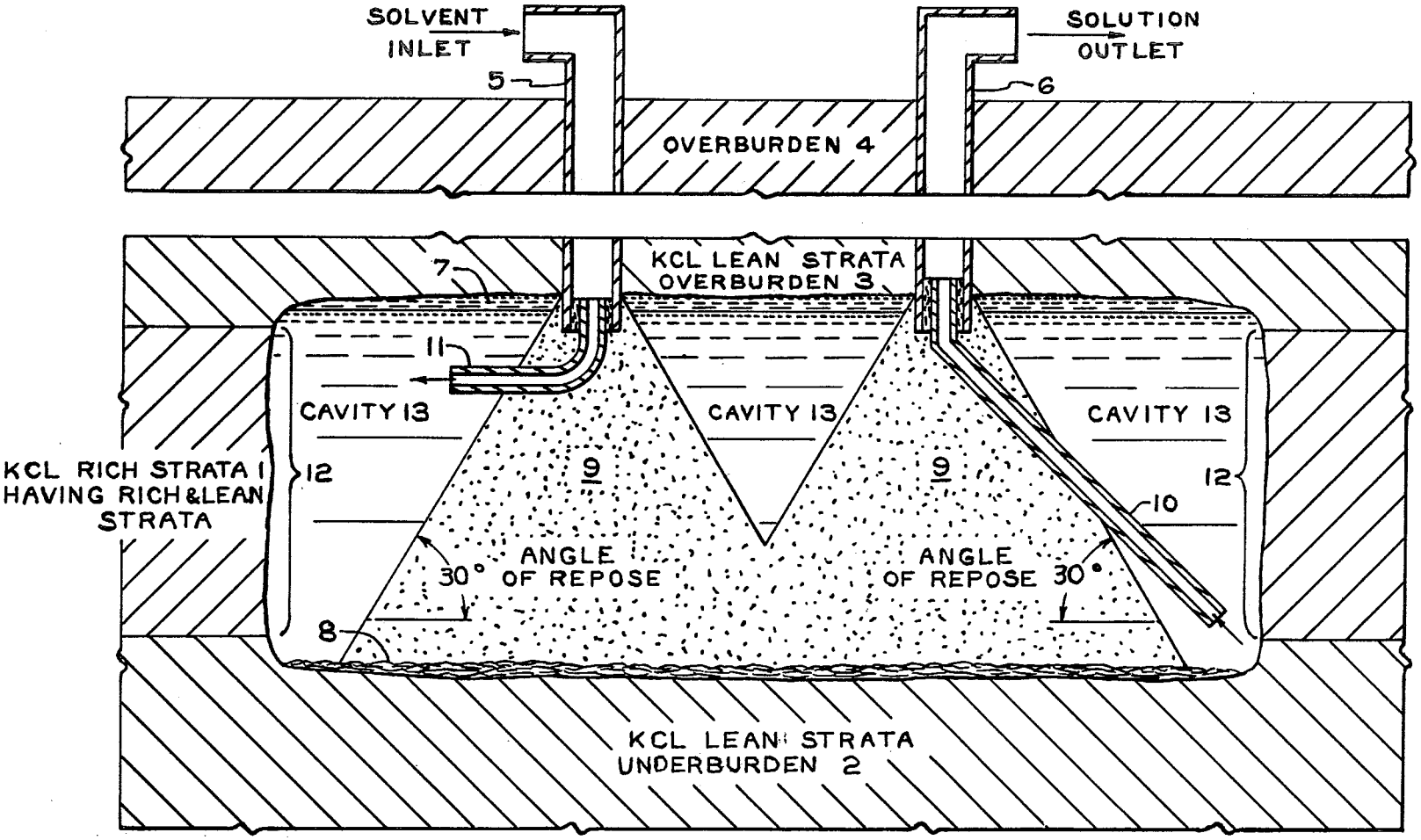
FIG. 1 illustrates an inactivated cavity selectively mined by the process of the present invention.

According to the present invention a subterranean salt deposit comprising potassium chloride rich strata which is alternately rich and lean in potassium chloride and sodium chloride content is solution mined by exposing to the action of a solvent slurried with solid sodium chloride a large area which traverses the strata. Hence, the solvent is exposed to a rubble of deposit ore or other large area faces which traverses the strata. It is only preferred that the cavity is mined in such a way that solid sodium chloride which is deposited in the cavity does not completely bury exposed faces which are to be mined.

Potassium chloride rich strata must contain on an average at least 15 percent $K_2O$ or 23 percent potassium chloride by weight in order to be commercially solution mined profitably by methods known in the art. Hence, with several cavities in operation, the mixture of mined solutions will have an average potassium chloride content sufficient to produce solid potassium chloride at economically attractive rates. These same strata can be mined selectively by the process of the present invention while disposing solid sodium chloride; moreover, solution withdrawn from each cavity mined by the present invention will be uniformly rich in potassium chloride (thus, avoiding sharp concentration peaks which would occur when rich strata is simultaneously mined in several cavities) and the solution may be at or near saturation with respect to potassium chloride for the temperature of the withdrawn solution.

The solvent used by the present invention will be a solution saturated with respect to sodium chloride, unsaturated with respect to potassium chloride, and slurried with solid sodium chloride. It is preferred that the solvent contain no potassium chloride but usually the solvent will contain some potassium chloride, especially when solution from initial cavity development or refinery process effluent is used as the solvent. It is only required that the solvent has a capacity to extract potassium chloride at economically feasible quantities and rates.

Solid sodium chloride which is produced during a refinery step of concentrating solution mined brine by evaporation or which is produced during froth flotation and the like will usually be that which is slurried with the solvent. The slurry density by volume is usually determined by the amount of solid sodium chloride it is desired to be deposited in a cavity or room. Less solid sodium chloride would be deposited in a rubble mined cavity than deposited in an inactivated cavity and, of course, pumping characteristics of the slurry may be a limiting factor. Accordingly, it has been found that a slurry comprising as high as about 35 percent solid sodium chloride content by volume has desirable fluid properties. This slurry will flow through rubble normally encountered by the present invention, it can be pumped by conventional pumps designed to transport slurry and it has a substantial quantity of solid sodium chloride to deposit in a cavity (e.g., in many cases the KCl/NaCl ratio in the cavity is such that as high as 25%–35% of the ore is selectively mined). Other slurry densities can also be used, however. Also, since for each 7 parts potassium chloride extracted from a cavity by a solvent containing no potassium chloride, 1 part sodium chloride is deposited from the solution of the solvent mother liquor; the slurry solid density is designed taking this into account to avoid supplying too many solids for the volume of voids created. In some instances this amount in itself can constitute substantial sodium chloride disposal such that no slurry of sodium chloride solids is necessary.

The temperature of the solvent would be high enough to supply enough heat so that after potassium chloride is dissolved, the net deposit temperature will be within 20° C. of its natural temperature. Hence, the temperature of the solvent will be up to about 50° C. higher than the solution withdrawn from the cavity. It is therefore preferred that the cavity has in communication therewith at least two bore holes thermally insulated from each other so that the solvent is not cooled by the withdrawn solution.

The solvent will be introduced into a cavity wherein a large face which traverses the strata, which is rich and lean in potassium chloride content, is present and it is preferred that it is introduced in such a manner that the contacting face will not be completely buried by solid sodium chloride. However, because of the highly fluid nature of a solvent slurry containing as high as about 35% sodium chloride solids by volume, a cavity which is desired to be abandoned can be substantially filled, e.g., more than 80% filled, by continuously pumping the surry into the cavity until a substantial filling is achieved. On the other hand, in some cases it may not be desirable to abandon a cavity which can be continuously mined by the method of this invention. This will be described with reference to and in conformity with the various embodiments of the present invention described hereinbelow.

Reference is now made to FIG. 1 which illustrates a subterranean formation containing deposits of potassium chloride, sodium chloride, and a minor amount of other salts and insoluble impurities, e.g., no more than about 23 percent by weight of other salts and insoluble impurities. The deposit contains potassium chloride lean strata 2 and 3 which contains less than about 23 percent by weight potassium chloride and potassium chloride rich strata 1 containing 23 percent to 50 percent potassium chloride by weight and the deposit has overburden 4. Cavity 13 has been developed primarily in rich strata 1 and has insulating blanket 7 protecting its roof and insolubles 8 protecting its floor.

A solvent saturated with respect to sodium chloride, unsaturated with respect to potassium chloride and containing 35 percent solid sodium chloride by volume is fed through inlet casing 5 and flexible tubing 11 into the top of cavity 13 directly below inlet casing 5 as solvent extracts potassium chloride from face 12 which is normal to rich strata 1 and withdrawn through tubing 10 (or liner) near the floor of cavity 13 and through outlet casing 6. It should be noted here that the angle of repose of solid sodium chloride in an aqueous solution containing potassium chloride and sodium chloride is taken into consideration for cavity size and well bore location so that face 12 is not completely buried by salt pile 9.

Inlet casing 5 is alternated with outlet casing 6 so that solvent is fed into outlet casing 6 which in this case would have a tubing similar to 11 thereby feeding solvent into the top of cavity 13. Solid sodium chloride is deposited below casing 6 while solvent extracts potassium chloride from face 12 and enriched solution is withdrawn through a flexible tubing in inlet casing 5 which is similar to tubing in inlet casing 5 which is similar to tubing 10 and through inlet (new outlet) casing 5. After alternating solvent feed through inlet casing 5 and outlet casing 6, sodium chloride pile 9 in cavity 13 should be as shown in FIG. 1. Hence, by mining in this manner face 12 is not buried, the possibility and extent of surface subsidence is reduced and saturated potassium chloride solution is displaced from the cavity.

Figure 2:
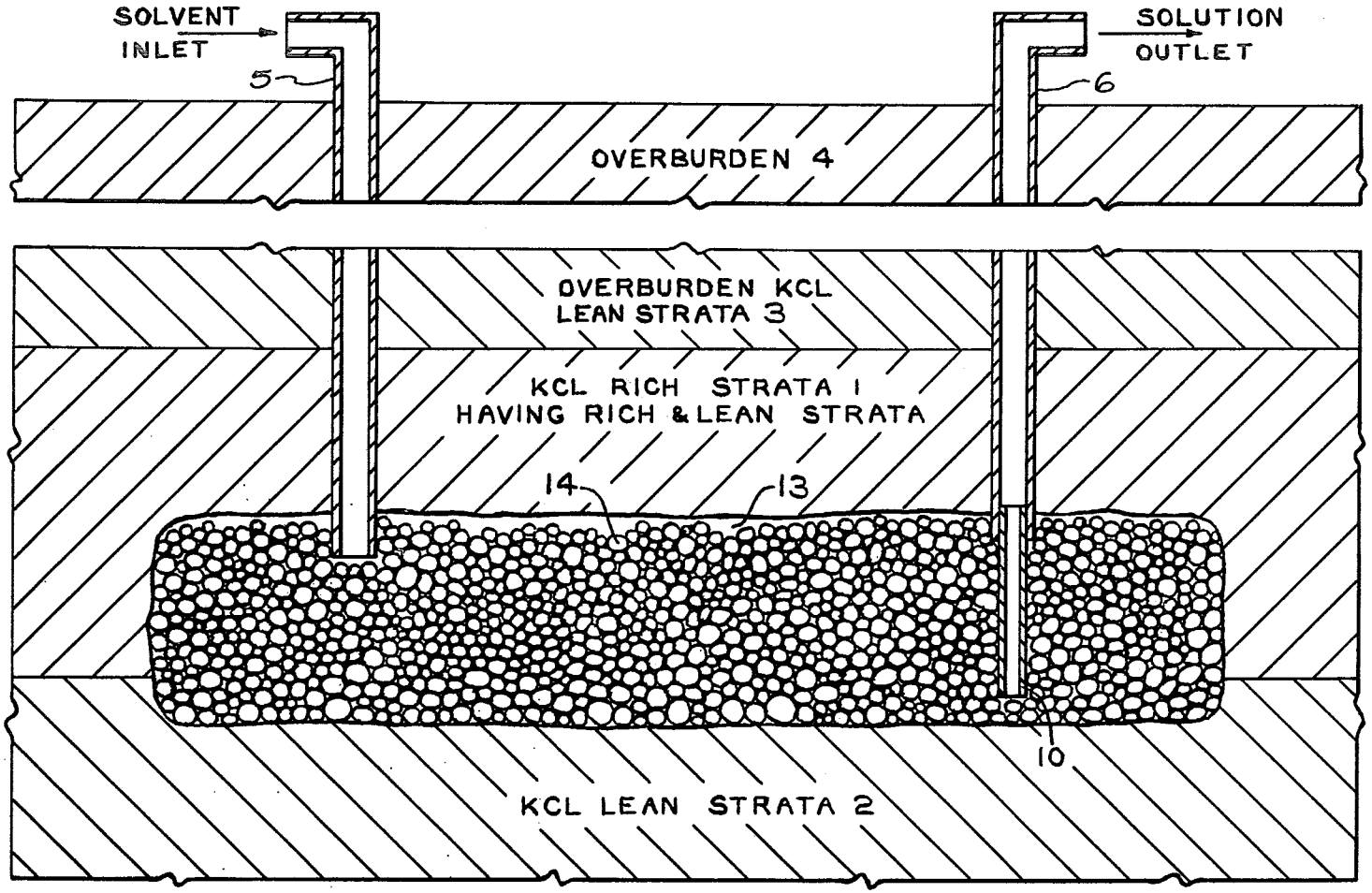
FIG. 2 illustrates a cavity which is selectively rubble mined according to the process of the present invention.

Reference is now made to FIG. 2 which illustrates a subterranean formation as in FIG. 1 except the cavity 13 therein is a cavity in an initial stage of rubble mining. The cavity is developed at the bottom of rich strata 1 and the top of lean underburden strata 2. The roof of cavity 13 is then caused to collapse into cavity 13 creating rubble 7. Tubing 10 is then placed down in rubble 7 to near the floor of cavity 13. A solvent saturated with respect to potassium chloride and containing 35 percent solid sodium chloride by volume is fed into inlet casing 5. The slurry percolates through the rubble because of its substantially fluid nature. The solvent extracts potassium chloride from the face of the rubble which has surface area having exposed ore containing on an average greater than 23 percent potassium chloride by weight or greater than 15 percent $K_2O$, as the solvent percolates to the bottom of the cavity. Solution enriched in potassium chloride is withdrawn through liner 10 and outlet casing 6. Potassium chloride is extracted from the rubble as the rubble volume decreases and void spaces in the rubble is left owing to compaction as potassium chloride is extracted. If a space is not left, a space is then created by a roof raise by introducing an appropriate solvent to extract ore from the roof. The roof is again caused to collapse into the space left or created and the cavity continually mined with the slurry solvent according to U.S. Pat. No. 3,148,000. Thus, the cavity 13 is mined upwardly through rich strata 1. When mining is completed a relatively small space remains. Hence, surface subsidence is limited.

Figure 3:
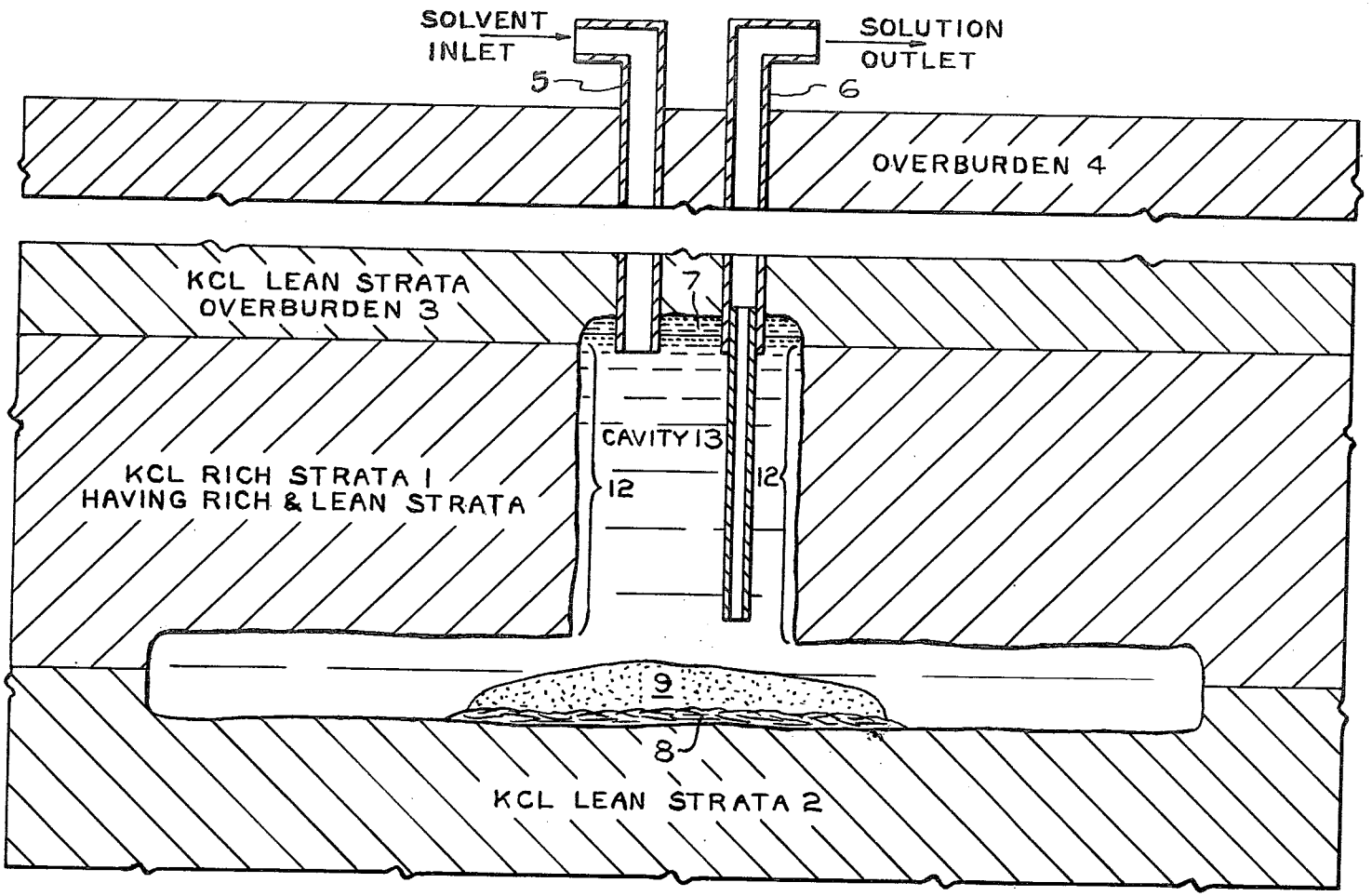
FIG. 3 illustrates a vertically elongated cavity having a larger bottom portion and which is selectively mined according to the present invention.

Reference is now made to FIG. 3 which illustrates a subterranean formation as in FIG. 1, except a cavity is developed so that it is vertically elongated and is at its initial stage of development. Cavity 13 is developed at the top of potassium chloride lean strata 2 and grown laterally within the lean strata 2 to a width where it is desired face 12 is to be mined. The vertical elongated portion of cavity 13 is then developed upwardly to lean strata 3 by methods well known in the art. Insulating fluid 7 is then placed at the roof of cavity 13. Wall 12 can then be mined by feeding a solvent saturated with respect to sodium chloride, unsaturated with respect to potassium chloride and containing 35 percent solid sodium chloride by volume. Solid sodium chloride 9 is deposited on the floor of cavity 13 on top of insolubles 8 which are deposited during development of the vertical elongation of cavity 13. As wall 12 is mined solid sodium chloride contained thereon falls to the floor of cavity 13. Thus, the dissolving face (wall) 13 is not buried by solid sodium chloride. Wall 12 can be mined laterally to the width of the bottom of cavity 13. When cavity 13 is fully developed, it will look similar to FIG. 1. Thus, when large quantities of sodium chloride are deposited on the floor of cavity 13, tubings 10 and 11 of FIG. 1 may be utilized. Again, in this embodiment of the invention it can be seen that a small space remains wherein subsidence is limited.

It can be seen by the described embodiments of the present invention that rooms from room and pillar type mines can be similarly mined by the process of the present invention, so long as large surface areas transversing the strata which are comprised of strata which are rich and lean in potassium chloride and which are exposed within the room. Hence, these deposits can be selectively mined with a solvent slurried with solid sodium chloride. It will be apparent to those skilled in the art that other embodiments of the inventive concept is possible. It is therefore not intended that the described embodiments be regarded as limitations upon the scope of the invention except insofar as they are included in the accompanying claims.

What is claimed is:

1. A method of disposing solid sodium chloride while selectively mining potassium chloride from a subterranean deposit containing potassium chloride and sodium chloride which comprises the steps of:

(A) injecting through a bore hole in communication with a cavity in the deposit, wherein face having rich and lean potassium chloride ore is exposed, an aqueous solvent saturated with respect to sodium chloride, unsaturated with respect to potassium chloride and slurried with solid sodium chloride, thereby depositing sodium chloride from the solvent slurry while dissolving potassium chloride; and (B) withdrawing from the cavity through a bore hole in communication therewith a solution enriched in potassium chloride.

2. The method of claim 1, wherein an average of more than 23 percent potassium chloride ore by weight is exposed.

3. The method of claim 1, wherein a large inactivated cavity is mined.

4. The method of claim 1, wherein the cavity is rubble mined.

5. The method of claim 1, wherein the solvent is injected into a first bore hole and the solution withdrawn from a second bore hole which is thermally insulated from the first bore hole.

6. The method of claim 1, wherein the solvent at up to 50° C. above the natural deposit temperature is fed into the cavity.

7. The method of claim 1, wherein the face exposed in the deposit is the wall of a room developed by room and pillar mining.

8. The method of claim 1, wherein solution enriched in potassium chloride is displaced by the sodium chloride solids.

9. The method of claim 3 or 7 wherein the cavity is substantially filled with solid sodium chloride.

10. The method of claim 3 or 7, wherein enough solid sodium chloride is deposited in the cavity so that during selective mining the size of the cavity is not enlarged.

11. A method of disposing solid sodium chloride while selectively mining potassium chloride from a subterranean can deposit containing potassium chloride and sodium chloride which comprises the steps of:

(A) injecting through a bore hole in communication with a cavity in the deposit wherein face having rich and lean potassium chloride ore is exposed, and aqueous solvent saturated with respect to sodium chloride and unsaturated with respect to potassium chloride, thereby depositing sodium chloride from the solvent solution while dissolving potassium chloride; and (B) withdrawing from the cavity through a bore hole in communication therewith a solution enriched in potassium chloride.

12. The method of claim 11, wherein a large inactivated cavity is mined.

13. The method of claim 11, wherein the face exposed in the deposit is the wall of a room developed by room and pillar mining.

* * * * *